United States Patent [19]

Badura et al.

[11] Patent Number: 4,621,579

[45] Date of Patent: Nov. 11, 1986

[54] DEVICE FOR PRODUCING A DECOY CLOUD, IN PARTICULAR AN INFRARED DECOY CLOUD

[75] Inventors: Wolfgang Badura, Bad Reichenhall; Gerhard Grau, Muellheim/Baden; Axel Widera, Ainring/Obb.; Kurt Adamek, Bischofswiesen, all of Fed. Rep. of Germany

[73] Assignee: Buck Chemisch-Technische Werke GmbH & Co., Bad Uberkingen, Fed. Rep. of Germany

[21] Appl. No.: 743,949

[22] Filed: Jun. 12, 1985

[30] Foreign Application Priority Data

Jun. 12, 1984 [DE] Fed. Rep. of Germany ..... 3421708

[51] Int. Cl.[4] ..... F42B 13/44

[52] U.S. Cl. ..... 102/334; 102/340; 102/342; 102/351; 102/357; 102/505

[58] Field of Search ..... 102/334, 340, 342, 351, 102/357, 505

[56] References Cited

U.S. PATENT DOCUMENTS

| | | | |
|---|---|---|---|
| 3,150,848 | 9/1964 | Lager | 89/1.51 |
| 3,720,167 | 3/1973 | Mainhardt et al. | 102/351 X |
| 3,760,729 | 9/1973 | Freeman | 102/357 X |
| 3,808,940 | 5/1974 | Schillreff et al. | 89/1.814 |
| 3,841,219 | 10/1974 | Schillreff | 102/342 |
| 4,069,762 | 1/1978 | Maury | 89/1.11 |
| 4,183,302 | 1/1980 | Schillreff | 102/505 X |
| 4,222,306 | 9/1980 | Maury | 102/342 |
| 4,406,227 | 9/1983 | Beeker et al. | 102/505 X |
| 4,436,034 | 3/1984 | Jacobsen et al. | 102/334 |
| 4,474,715 | 10/1984 | Weber et al. | 102/334 X |
| 4,498,392 | 2/1985 | Billard et al. | 102/342 |
| 4,505,202 | 3/1985 | Fidler et al. | 102/505 X |

FOREIGN PATENT DOCUMENTS

| | | | |
|---|---|---|---|
| 2908116 | 9/1979 | Fed. Rep. of Germany | 102/334 |
| 2908217 | 9/1979 | Fed. Rep. of Germany | 102/334 |

*Primary Examiner*—Peter A. Nelson

[57] ABSTRACT

Device for producing a series of consecutive decoy clouds, in particular infrared decoy clouds which move progressively away from the actual target, in which several projectiles (A, B, C, D, E, F, G) are arranged within a thin walled discharge tube (1), each projectile is practically of identical construction and has a separate ignition disintegrator unit (10) for disintegrating it and for igniting and scattering the combustible charge (18) to form a decoy cloud, a separate ejection chamber (27) provided with a propellant charge cartridge (28) is provided on each projectile, each propellant charge cartridge (28) can be ignited via a separate electrically actuated ignition lead (5) by means of a command controlled ignition distributor unit (69) and each projectile has a separate percussion fuse (47) for the ignition disintegrator unit (10) which can be actuated by releasing its safety device (360 mechanically, its safety device (36) only being released after ignition of the propellant charge cartridge (28) with opening of the ejection chamber (27) and after the projectile has left the discharge tube (1) and due to the acceleration of the projectile.

19 Claims, 4 Drawing Figures

DEVICE FOR PRODUCING A DECOY CLOUD, IN PARTICULAR AN INFRARED DECOY CLOUD

Figure 1:
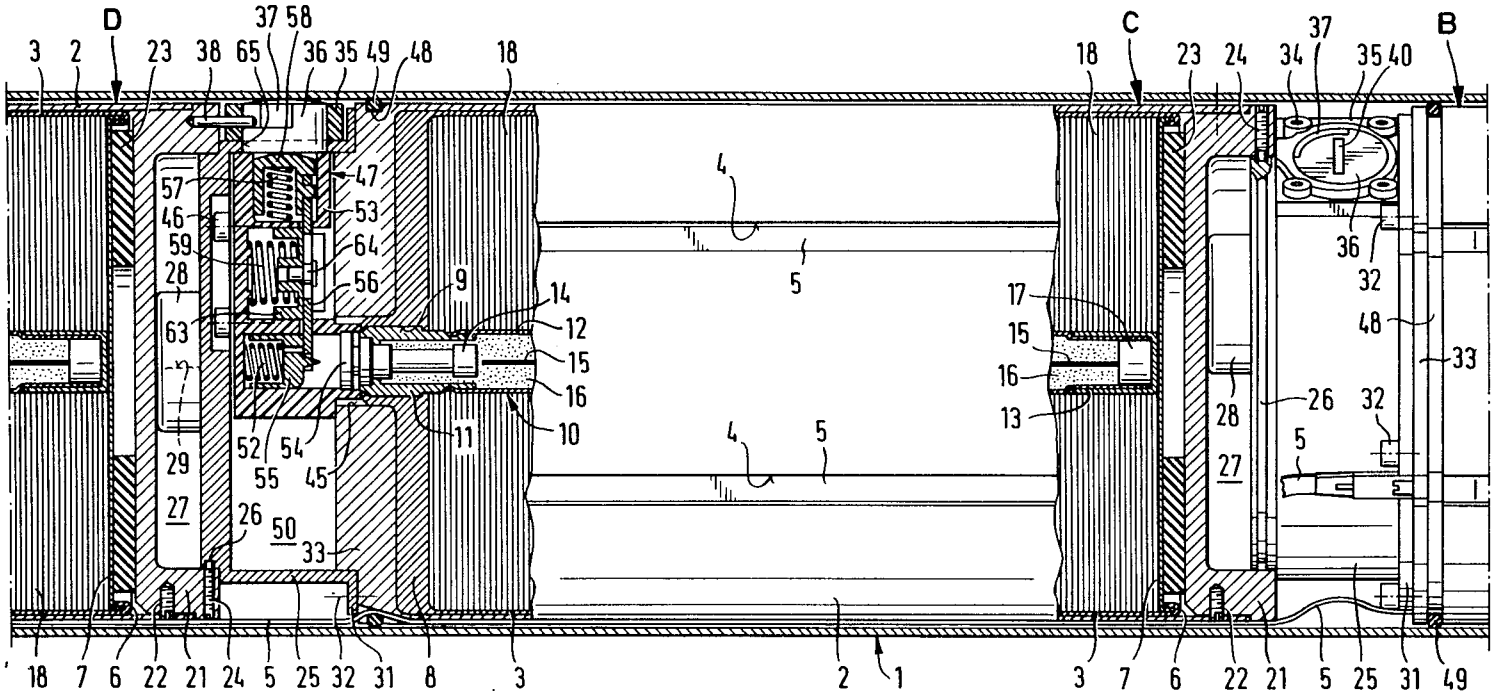

The subject matter of the invention is a device for producing a decoy cloud, in particular an infrared decoy cloud with the aid of projectiles discharged from a launcher tube which are loaded with a charge for producing the desired decoy cloud in particular a combustible charge for producing an infrared decoy cloud.

It is known that infrared radiating targets, such as ships, can be protected from missiles equipped with infrared homing heads by positioning an infrared decoy with a higher infrared radiant power than the intended target adjacent to or above the target, but within the range of the infrared homing head optical system. Infrared decoy clouds formed by firing a projectile incorporating a combustible charge (so-called pyrotechnical flares) using for example conventional launchers, and by fragmentation of the projectile at a certain distance from the target and simultaneous ignition and scattering of the burning charge are particularly suitable for this purpose. Infrared flares also exist in addition to these decoy clouds. These are however, only spotbeam radiators and are thus less suitable for deception purposes than decoy clouds which provide a large volume radiation source with a high radiant power and slow rate of descent. The latter are therefore preferable when countermeasures are to be initiated.

The formation of a single infrared decoy cloud or several decoy clouds not however acting in conjunction is usually a perfectly adequate countermeasure for smaller targets, for example patrol boats, but involves disadvantages and uncertainties in the case of larger targets, i.e. large ships such as frigates, due at least in part to the manner in which the infrared homing heads of the attacking missiles function. These homing heads have optical heads with relatively large angles of aperture at the start of the so-called search phase, but whose angle of vision becomes increasingly smaller after detection of the target and as the missile approaches the target i.e. after lock-on. In order to deflect a missile which is already locked on to the target, the infrared decoy cloud required for this must therefore be positioned at a relatively short distance over or next to the target i.e. the ship under attack, so that this decoy can be detected at all by the optical system of the missile homing head. A decoy at such close proximity is usually adequate for the effective protection of a small target, for example a patrol boat, since in this case, the radiation centre of gravity formed by the target and decoy is far enough away from the intended target and is deflected increasingly towards the decoy as the missile approaches. It is generally not adequate, however, for a larger ship with correspondingly larger superstructure, since in this case the radiation centre of gravity formed by the decoy and the ship is too close to the ship. Larger targets and thus particularly larger ships, cannot therefore be adequately protected by the known devices for producing infrared decoy clouds.

On the basis of the known devices for producing an individual decoy cloud, the objective underlying this invention therefore is to create a new device for firing projectiles which, due to its special design and its mode of operation, enables several projectiles to be fired in sequence from the intended target, especially from ships and in particular from large ships, in such a way that a chain of consecutive new infrared decoy clouds is produced propagated from the first infrared decoy cloud formed so as to produce a decoy which moves constantly away from the intended target. A device of this kind should at the same tixe be of space and weight saving design, feature a high degree of safety when being handled and in the ready state, consist of few largely identical components and disintegrate in operation into relatively small fragments which do not result in any damage to the target it is intended to protect. It should also be possible in emergencies for the device to be discharged as a complete integral block without endangering the target to be protected in this way. The device should in addition be sufficiently flexible to allow the individual decoys to be formed always in the same place, and thus either provide a stationary decoy with a longer burning time or a larger area decoy with a shorter burning time.

On the basis of a device of the type specified at the beginning, this problem is now solved in accordance with this invention essentially by the characteristic features of claim 1, namely in that (a) several projectiles are provided within the launcher tube, (b) every projectile is practically of identical construction and has a combustible charge and a separate ignition/disintegrator unit for disintegrating the projectile, for simultaneous ignition of the combustible charge and for scattering the charge to form the decoy cloud, (c) an ejection chamber provided with a propellant charge cartridge is fitted in the base section of every projectile.

(d) Each propellant charge cartridge is connected via a separate electrically activated ignition lead to a common, command controlled ignition distributor unit allocated to the bottom projectile, and (e) each projectile has in its base section a separate percussion fuse which can be actuated by mechanical release of its safety device for the ignition distributor unit whose safety device is released only after ignition of the propellant charge cartridge with opening of the specific ejection chamber and after leaving the launcher tube, and by the acceleration of the projectile.

Preferred forms of these devices are described in Sub-Claims 2–16.

The stacked arrangement of the individual projectiles in the launcher tube of the device according to the invention has the advantage that the pressure and impact load on the launcher tube is greatly reduced. This makes it possible to use a relatively narrow and thin walled launcher tube. The individual projectiles required for its assembly are initially prepared so that each projectile contains a cup-shaped cover at the top while the cup-shaped base section is located at the bottom of the same projectile, which has an eccentric hole drilled in it, into which the propellant charge cartridge can be inserted from below once the entire projectile is completely assembled. The percussion fuse located on the base section of a projectile of this type in the chamber formed by the cup-shaped cover can thus also be installed as a whole, including the safety device provided for security and all other components such as delay action element, ignition disintegration unit and combustible charge, before the individual complete projectiles are simply stacked one on top of the other in a final operation after finally introducing the propellant charge cartridge. Altogether, this results in considerably greater safety when handling the device according to this invention during its manufacture and also in use.

The insertion of the combustible charge in a thin walled aluminium inner container enables this container simply to be crimped to a thin aluminium cover to form a gas-tight seal. The thick walled outer container around about it gives the projectile and the arrangement of several such projectiles great resistance to the stresses occurring during discharge. At the same time, the grooves in the outer casing of the outer container fulfill a useful double function; they provide space for accommodating the necessary ignition leads and also provide predetermined breaking points at which the thick walled outer container can burst more easily. At the same time, no large fragments are formed during disintegration but smaller fragments with correspondingly lower velocity are scattered about over a wide area. Another advantage of the device according to the invention is that in emergency situations, it is possible to ignite only the bottcm projectile assigned to the command controlled ignition distributor head. The entire assembly of individual projectiles can be fired from the launcher tube without a possibly dan9erous ignition of the propellant charges in the other projectiles or actuation of their percussion fuses with detonation of the ignition disintegrator charge, since the individual projectiles are not separated from one another, but are discharged joined together as a stack. In this case, only the bottoa projectile disintegrates while the other projectiles simply fall into the sea for example, without having functioned. The specially designed safety system provided in the device according to the invention thus offers a number of very important advantages.

One of the main advantages of the use according to the invention of a single launcher tube in which all projectiles to be fired are positioned is that the guide path in the launcher tube becomes increasingly long as the individual projectiles are fired. As a consequence, the accuracy and range of the later projectiles fired increases, thus producing the relatively accurate straight line required for forming the propagated chain of consecutive infrared decoy clouds. The longer acceleration path also offsets to a not inconsiderable extent, the need for a larger quantity of propellant which would otherwise be necessary for the longer trajectories. This in turn results overall in less recoil and thus in reduced stressing over the weapon.

As a result of the need to produce a propagated chain of consecutive new infrared decoy clouds in order to form a decoy which distances itself progressively from the intended target, it is necessary to form the subsequent new infrared decoy cloud in each case after an interval and to fire the corresponding projectile accordingly after such an interval that the burning time overlaps the burning time of the proceeding infrared decoy cloud by about 1–2 seconds. Longer overlapping times are not detrixental. As a rule however, two thirds of the burning tixe of the individual decoy clouds should not be exceeded because otherwise more than three clouds radiate simultaneously and the impression made by the decoy as it moves away, is excessively blurred. This also applies analogously to the stationary decoy cloud. This decoy cloud is however, only a secondary requirement of the task underlying this invention, for the implementation of which, it is only necessary to alter the amounts of propellant charge and the delay tixes of the delay action elements, so there is no need to go into this in more detail.

Allowing for an adequate duration of the overall countermeasure and the required overlap time, the optimum burning time and thus the life of a single decoy is between 9 and 15 seconds. The burning time of the combustible charge must therefore be at least 9 seconds, and should not exceed 15 seconds. Furthermore, its rate of descent must be very slow since otherwise, the distance to the next cloud might well be so great as to prevent the next cloud from being detected by the infrared homing head, or at the least, both clouds are so far apart that they no longer form a uniform decoy. These conditions are fulfilled by combustible charges as described in BE-PS 874 835. This is a charge based on thin combustible flakes, whose burning characteristics are essentially provided by a slow-burning combustible layer coated on one or both sides, consisting of an inflammable paste based on red phosphorous. The substrate material for these flakes can be a plastic film, a metal foil such as aluminium foil, or paper, paper being the preferred substrate material. The basis weight of the substrate material ideally ranges up to about 60 $g/m^2$. When ready for use, i.e. when coated with inflammable paste, the flakes can have a basis weight up to about 400 $g/m^2$. Flakes of this kind usually have the advantage compared with strips, that as a result of their larger area they float better in the air and therefore fall slowly. These flakes should preferably be designed so that they are sector shaped, particularly in the shape of a sector with an angle of about 120°. Another advantage in addition to the one mentioned above, is that flakes of this shape can be arranged radially aroun-d a central ignition disintegrator unit in the projectile which ensures a rapid and uniform ignition of the combustible charge and at the same tixe, the required clean disintegration of the projectile with formation of a practically spherical infrared decoy cloud. A combustible charge of this composition and design in the form of sector-shaped flakes has the desired long burning time of, for example, between about 9 and 15 seconds.

In the preferred version the sector-shaped flakes used for the combustible charge form a circle held together with thin connecting strips. Flakes of this type can then be stacked more easily and in addition provide very readily inflammable points at the connecting strips.

The timing of the firing of the individual projectiles from the single launcher tube and disintegration with ignition and scattering of the combustible charge contained therein depends on the speed and distance of the missile to be deflected, the size, direction of travel and speed of the object to be protected and the burning tixe, and thus the duration of the protection provided by the infrared decoy cloud. Timing is normally set so that another new infrared decoy cloud is produced at the earliest every 3 and at the latest, every 13 seconds so as to form part of the propagated chain of new infrared decoy clouds. Shorter tixe intervals, e.g. down to 1 second and less, are however, possible in exceptional cases.

A method for the protection of infrared radiating targets, in particular ships, from missiles equipped with infrared homing heads is also described in the patent application, Ser. No. 744,144 of the same applicant, submitted on the same day as this application.

Figure 2:
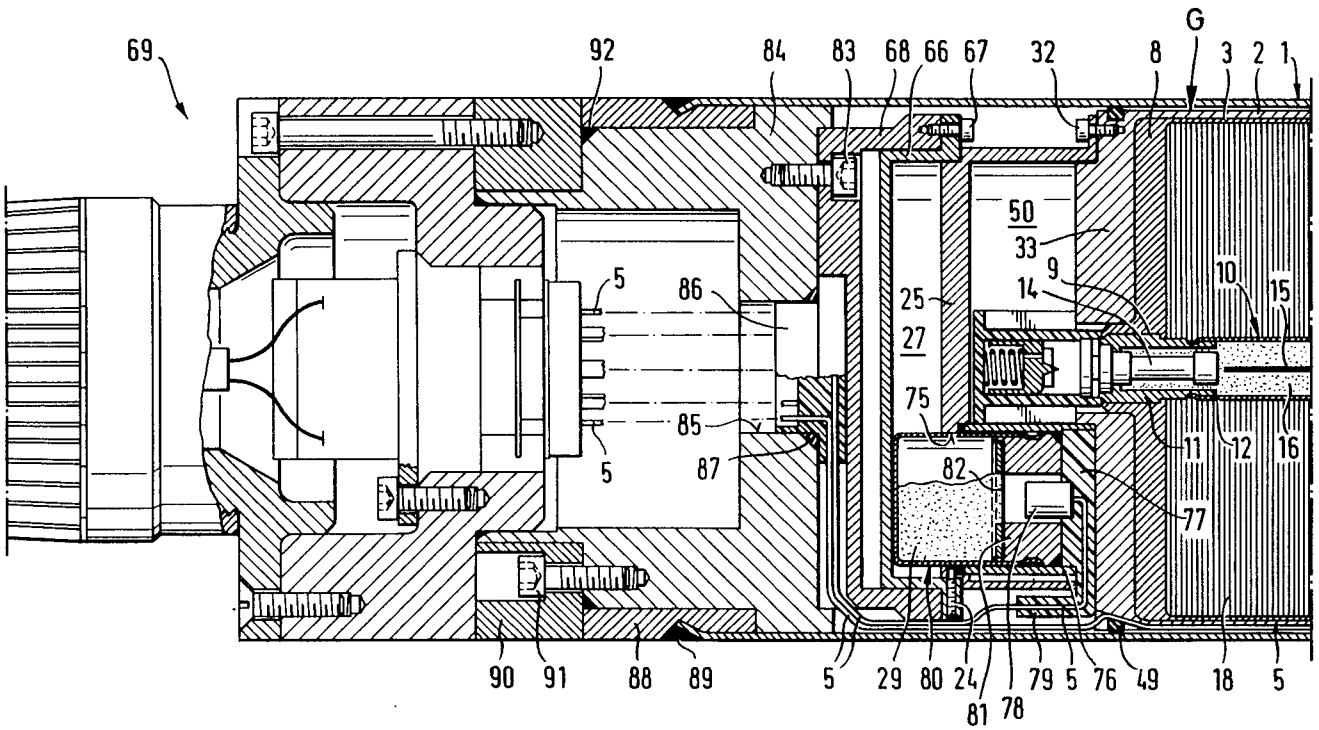
Figure 3:
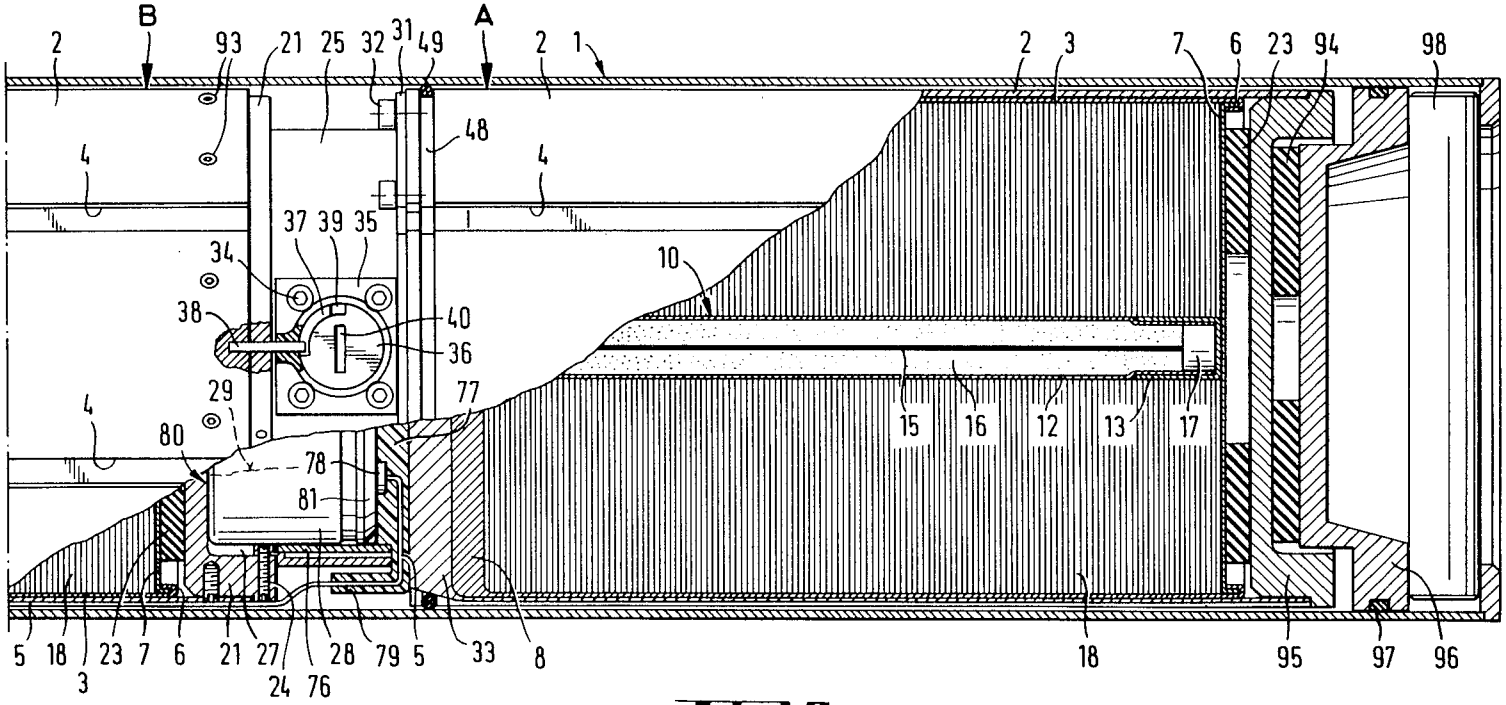
Figure 4:
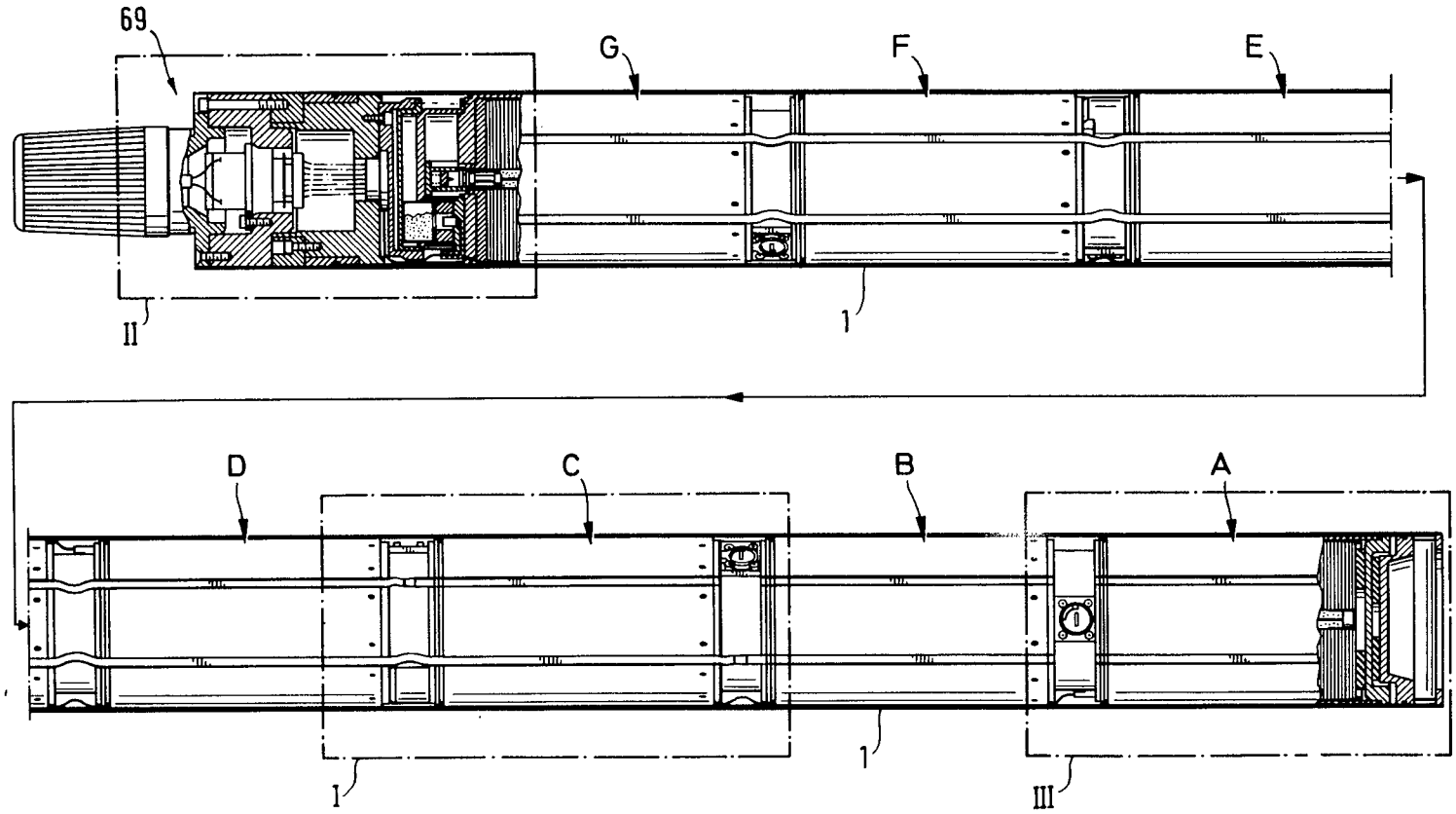

The invention is described in more detail in the following with reference to the Figures which show the following:

FIG. 1 A partially cut away view of a central section of the device according to the invention;

FIG. 2 A largely cut away view of a section at the base of the device according to the invention;

FIG. 3 A largely cut away view of a section at the top of the device according to the invention; FIG. 4 A partially cut away view of the entire device according to the invention which includes the sections shown in FIGS. 1, 2 and 3.

FIG. 1 shows in detail a projectile C which has a projectile D which is shown only in part connected at the bottcm end and a projectile B, likewise only shown in part, connected to its to end. Projectile C is located in a launcher tube 1, together with projectiles B and D, which are only shown in part. This launcher tube is a relatively thin walled aluminium tube which normally has a wall thickness of about 1.5 to 2 mm. Projectile C in launcher tube 1 consists of a thick walled outer contain 2, and a thin walled, can-shaped inner container 3, enclosed tightly by this outer container 2. Both outer container 2 and inner container 3 consist entirely of aluminium, the former usually having a wall thickness of about 1.5 to 2 mm and the latter a wall thickness of about 0.2 to 0.4 mm. Both containers are preferably drawn aluminium containers.

Grooves 4 are provided parallel to the axis in the outer casing surface of outer container 2 of projectile C (and also on the outside casing surfaces of the other projectiles), and these hold the ignition leads 5 and also provide predetermined breaking points for the disintegration of outer container 2. The number of these grooves 4 corresponds accordingly to the total number of projectiles present in launcher tube 1 minus one projectile, since the projectiles located directly on a command controlled ignition distributor unit is supplied with its required ignition lead 5 directly from this unit. The other ignition leads for the other projectiles must on the other hand be lead to the individual projectiles via the grooves 4 in the outer casing surfaces of each outer container 2. In a device according to the invention, whose launcher tube is loaded with, for example, seven projectiles, i.e. projectiles A, B, C, D, E, F and G, there are therefore a total of six grooves parallel to the axis in the outer casing surfaces of the individual outer containers 2. In a device of this design, the individual ignition leads terminate in helical form, offset in each case by an angle of 60°.

Inner container 3 is closed with a container cover 7 which is also thin walled and made of aluminium via a crimped joint 6, to provide a gas-tight seal.

A hole 9 is drilled centrally in the reinforced base 8 of inner container 3 into which an ignition disintegrator unit 10 is inserted, which passes through the inside of inner container 3 practically to the container cover 7. This ignition disintegrator unit 10 consists in detail of an adapter 11 which is inserted as a tight fit into whole 9 and has a thin aluminium sleeve 12 crimped to it which is closed at the end towards container cover 7 by an aluminium cap 13. A delay action element 14 which is connected operationally with an ignition core 15 which runs centrally through aluminium sleeve 12 is located inside adapter 11 of ignition disintegrator units 10. The ignition core 15 is surrounded by an ignition disintegrator composition 16 which fills the entire remaining inside space in the aluminium sleeve 12 and is closed by a plastic plug 17 in the vicinity of the aluminium cap 13.

The inside space in the inner container 3 is filled completely by the combustible charge 18 arranged around the ignition disintegrator unit. In the version shown, this charge 18 is a combustible charge for producing an infrared decoy cloud. This combustible charge 18 is a stack of thin sector-shaped flakes 18 coated with a combustible layer, arranged radially around the ignition disintegrator unit 10, the leaves being in the form of sectors with an angle of about 120°, which are held together as the case may be, via thin connecting strips, thus forming a circle held together by these connecting strips.

Outer container 2 of projectile C is closed at the top by a cup-shaped cover 21 which is held to the casing of the outer container 2 by screws 22. If necessary, this connection can also be made by a simple plug-in connection or adhesive joint.

A plastic insulating disk 21 is placed between the cover 7 of inner container 3 and the cup-shaped cover 21 of outer container 2. This allows for dimensional tolerances and ensures that inner container 3 sits tightly in outer container 2.

Set screws 24 are provided in the rim of the cup-shaped cover 21 which penetrate the rim and via which cup-shaped base 25 of projectile B inserted afterwards is joined so that it can sheer off. In the versions shown, set screws 24 in the rim of cup-shaped cover 21 engage in an annular groove 26 in the cup-shaped base 25 of projectile B inserted afterwards so that the cup-shaped cover 21 of projectile C forms an ejection chamber 27 in conjunction with the cup-shaped base 25 of projectile B inserted afterwards which is opened by the sheering off of set screws 24 under the pressure of the combustion gases produced by a propellant charge 29. The propellant charge 29 contained in a propellant charge cartridge 28 is ignited via an ignition lead 5 which is not visible in the figure, which is routed in a groove 4 which is not visible in the figure either, via the command control ignition distributor unit of the device according to the invention.

The cup-shaped base 25 of projectile B is fixed via flange 31 to the reinforced base 33 of outer container 2 of projectile B by means of screws 32. A guide plate 35 is fixed to the outer casing surface of the cup-shaped base 25 of projectile B by means of screws 34. A safety device 36 which passes through a drill hole in the casing of outer container 2 and is connected with the spring-loaded safety head of a percussion fuse located beneath is held in the guide plate so that it can rotate. The safety device 36 has a guide groove 37 in which a locking pin 38 fixed in the rim of the cup-shaped cover 21 of the proceeding projectile C or of projectile D inserted before it engages. The guide groove 37 of safety device 36 changes at one end into the release groove 39 which penetrates the outer casing of safety device 36, by means of which groove safety device 36 can be released by rotating until the locking pins 38 engage in the release groove 39. A positioning notch 40 is provided in the head of safety device 36 to facilitate this operation.

Just like the reinforced base 8 of inner container 3, the reinforced base section 33 of outer container 2 of projectile C also has a central hole 45 drilled in it via which a percussion fuse 47 fixed to base section 33 by means of screws 46 is connected operationally to delay action element 14.

An annular ring 48 is cut in the outer casing of the base section 33, in which an O-ring 49 is positioned. This O-ring 49 fulfills two functions. Firstly it provides a tight seal for projectile C (and also the other projectiles) in launcher tube 1 and secondly holds the ignition leads 5 firmly in grooves 4.

The cup-shaped base 25 is also fixed to the base section 33 of outer container 2 of projectile C via flange 31 by means of screws 32. The chamber 50 formed by base section 33 and cup-shaped base 25 firstly holds the percussion fuse 47 and secondly holds part of the propellant charge cartridge 28.

The percussion fuse 47 is a conventional percussion fuse which is made active only by a combination of the releasing of safety device 36 and simultaneous release of another safety mechanism by the acceleration of the projectile. It consists pf a plastic housing 53 containing a prixer 54 connected operationally with delay action element 14; the prixer can be detonated via a spring-loaded firing pin 55 with a firing spring 52. Firing pin 55 is secured and can be released via a conventional safety chain. This safety chain consists of a sliding element 56 with double safety mechanism. The first safety mechanism comprises a spring-loaded safety element made up of a release spring 57 and safety cap 58 connected to sliding element 56; the second safety mechanism is also a spring-loaded safety element responding only to acceleration, consisting of a weight spring 59, a weight 63 and a spring dowel pin 64, provided in sliding element 56. The spring-loaded safety element is connected with safety device 36 which passes through a hole 65 drilled in the casing of the cup-shaped base 25 and is guided by guide plate 35 fixed to the surface of its casing. Safety device 36 is held in the safe position firstly via locking pin 38 located in its guide groove 37 which is fixed in the rim of cup-shaped cover 21 of projectile D inserted before, and secondly via launcher tube 1. When the ejection chamber 27 formed by cup-shaped cover 21 of projectile D and cup-shaped base 25 of projectile C (thus by two successive projectiles in each case) opens, the locking pin 38 remains on the cup-shaped cover 21 and thus release guide groove 37 of safety device 36 which forms the first safety mechanism. Safety device 36 is not however released from the second safety position until safety device 36 leaves launch tube 1, so that the release spring 57 of safety cap 58 connected to sliding element 56 can be released. Not until the sliding element 56 is also released by the additional safety mechanism responding to acceleration comprising weight spring 56, weight 63 and spring dial pin 64 does sliding element 56 move and release the spring-loaded firing pin 55.

Next to percussion spring 47 is the propellant charge cartridge 28 which is inserted through a hole drilled in the bottcm of the cup-shaped base 25 and thereby engages in ejection chamber 27 formed by the cup-shaped base 25 of projectile C and the cup-shaped cover 21 of projectile D inserted before. The exact shape and arrangement of the propellant charge cartridge can be seen in FIGS. 2 and 3.

FIG. 2 shows in detail launcher tube 1 with a projectile G inserted in it which is only shown in part. This projectile G is of exactly identical construction to projectile C described in detail above with reference to FIG. 1.

It consists accordingly of a thick walled outer container 2 and a thin walled can-shaped inner container 3 enclosed tightly by this outer container 2. Grooves 4 parallel to the axis are provided in the outer casing surface of outer container 2 of projectile G, in which the ignition leads 5 are routed and which at the same time form predetermined breaking points. Hole 9 is drilled centrally in the reinforced base 8 of inner container 3, into which the ignition disintegrator unit 10 is inserted, of which the adapter 11 with aluminium sleeve 12, delay action element 14, ignition core 15 and the ignition disintegrator composition 16 are to be seen. The combustible charge 18 is inserted in the space inside in container 3.

The cup-shaped base 25 is fixed to the reinforced base section 33 of outer container 2 via flange 31 by means of screws 32. The chamber 50 formed by base section 33 and cup-shaped base 25 contains the percussion fuse 47, of which only the plastic housing 53, the prixer 54, the firing pin 55 and firing spring 52 can be seen in the Figure. Annular groove 48 is cut in the outer casing of base section 33 and holds O-ring 49. The central drill hole 45 in which part of the percussion fuse 47 engages can also be seen in the base section 33. The annular ring 26 can be seen on the cup-shaped base 25 to which a cup-shaped cover 66 which corresponds largely to the cup-shaped cover 21 described in FIG. 1 is fixed by means of set screws 24 which can sheer off. Cover 66 is permanently joined via screws 67 to an intermediate cover 68 which forms part of the command controlled ignition distributor unit 69.

The ejection chamber 27 formed by the cup-shaped base 25 and cup-shaped cover 66 contains the propellant charge cartridge 28 which engages in a hole 75 drilled in the bottom of the cup-shaped base 25 and passes through space 50 formed by cup-shaped base 25 and base section 33 of outer container 2. A guide sleeve 76 which reaches as far as the base section 33 of outer container 3 and engages in a radial recess provided in it is located in drill hole 75 to hold the propellant charge cartridge 28 and to provide a tight seal against the space occupied by the percussion fuse 47. A plug connector insert 77 is accommodated in the end of the guide sleeve 76 towards the base section 33; a primer capsule 78 is fixed centrally in this, connected via ignition lead 5 and a plug connector 79 to the assigned ignition lead 5 from the ignition distributor unit 69. The propellant charge cartridge 28 consists of a thin walled aluminium container 80 with annular chamber base 81 for holding the primer capsule 78, and of the propellant charge 29 contained in the space inside the aluminium container 80. The propellant charge 29 is sealed from primer capsule 78 with a conventional primer cover 82. This design offers the special advantage that the propellant charge cartridge can be inserted easily from the bottom of the cup-shaped base into guide sleeve 76 after the projectile has been completely assembled.

The command control ignition distributor unit 69 consists in detail of the intermediate cover 68 and a cup-shaped anchor flange 84 connected to it via screws 83, which has a plastic wire harness 86 located in its central drill hole 85 sealed off via a O-ring 87. This wire harness has grooves which cannot be seen for guiding and distributing the ignition leads 5 for the individual projectiles.

The thrust ring 88 located on a shoulder of the anchor flange 84 joins launcher tube 1 to ignition distributor unit 69. This thrust ring 88 is permanently joined to launcher tube 1 via a welded seam 89. Thrust ring 88 is fixed to the anchor flange 84 by means of screws 91 via a base ring 90 and is sealed with an O-ring 92. This base ring 90 is also used for fixing other standard components of the ignition distributor units 69 which are not described in more detail here.

FIG. 3 shows in detail launch tube 1 with projectile A in it and projectile B shown only in part. Projectile A is of identical design to projectile C described earlier with reference to FIG. 1 with the exception that the cup shaped cover 95 at the top does not have any set screws 24, since unlike the cup-shaped cover 21 of all projectiles inserted before it does not need to be connected to the cup-shaped base 25 of a projectile inserted after it.

A sealing cover 96 is connected to the cup-shaped cover 95 via another insulating disk 94 placed in between which is sealed from launcher tube 1 via an O-ring 97 and fixed in suitable fashion. The device according to the invention is closed at the top by means of a carrier bar 98 fixed in launcher tube 1.

Projectile A consists of the thick walled outer container 2 and the thin walled can-shaped inner container 3 enclosed tightly by it. Grooves 4 parallel to the axis are provided in the outer casing surface of outer container 2 although these do not have any ignition leads 5 routed along them since there are no further projectiles following projectile A. The central hole 9 is drilled in the reinforced base 8 of inner container 3 which cannot be seen in this figure contains the ignition disintegrator unit 10 of which only the aluminium sleeve 12, the ignition core 15, the ignition disintegrator composition 16, the aluminium cap 13 and plastic plug 17 can be seen.

The inner container 3 of the projectile is sealed by base cover 7 via crimped joint 6 so that it is gas-tight. This base cover is followed by insulating disk 23 situated between it and cup-shaped cover 95. The remaining space in inner container 3 is filled entirely with the sector-shaped combustible charge 18.

An annular groove 48 in which O-ring 49 is inserted is cut in the outer casing of the base section 33 of outer container 2. The cup-shaped base 25 is also fixed to the base section 33 via flange 31 by means of screws 32. The outer casing surface of base 25 carries the guide plate 35 fixed to it with screws 34; the hole drilled centrally in this plate contains safety device 36 which engages in a corresponding hole drilled in the casing of cup-shaped base 25. The safety device 36 has a positioning notch 40, release groove 39 and guide groove 37 in which the locking pin 38 which is stuck in the rim of the cup-shaped cover 21 engages.

Holes 93 are drilled in the casing of outer container B (and also the other outer containers) which hold screws 22 which are not shown here.

The propellant charge cartridge 28 is located in the ejection chamber 27 formed by the cup-shaped cover 21 of projectile B and the cup-shaped base 25 of projectile A; this cartridge is of the same design as described above for FIG. 2 and is connected to ignition lead 5. A detailed description of the additional components present for this can therefore be omitted.

The detailed description of FIG. 4 is not necessary since it only shows an overall view of the device according to the invention including the parts already described in FIGS. 1, 2 and 3. The main components of this device are the command controlled ignition distributor unit 69, launcher tube 1 and the total of seven projectiles A, B, C, D, E, F and G contained therein.

All individual components of this device are included in the above descriptions for FIGS. 1, 2 and 3.

The device according to the invention for producing a decoy cloud, in particular an infrared decoy cloud, preferably contains a total of seven projectiles (A, B, C, D, E, F and G) in its launcher tube; the propellant charge in the propellant charge cartridge of each projectile is so designed that when the projectiles in the launcher tube are fired in sequence at suitable intervals and with disintegration of the projectile and ignition and scattering of the combustible charge contained in it, this results in the required chain of successive new infrared decoy clouds propagated in each case from the proceeding decoy cloud and beginning with the infrared decoy cloud formed by the first projectile (projectile A), so as to form overall a decoy which moves constantly away from the intended target. The series of individual projectiles contained in the launcher tube should therefore be fired with parabolic trajectories which ensure that the required decoy is formed which moves away from the target. This means that the individual projectiles must be fired increasingly long distances to make allowance for the speed of the target, i.e. a ship. This can be achieved by various measures familiar to the specialist and in the case of the device according to the invention, is preferably achieved by increasing the amount of propellant in the propellant charge cartridges of each projectile progressively from the top to the bottom. Independently of this or parallel to it, the disintegration of the individual projectiles in the required sequence and at the required distance can or must be regulated by delay times specific to each delay action element. While the quantity of propellant in each propellant charge cartridge is generally increased progressively from the top to the bottom projectile to achieve the desired effect, at the same time the delay time of the individual delay action elements is normally increased in the same direction too, since the projectile at the mouth of the launcher tube has to be disintegrated after a shorter distance in time than the projectile at the bottom of the launcher tube. The need to fire and disintegrate the individual projectiles at increasing distances to form a decoy cloud which moves away as required is generally taken into account by increasing the amount of propellant charge at the delay time of the ignition delay action elements. The progressive increase in length of the acceleration path in the launcher tube from one projectile to the next has a beneficial effect as regards the quantity of propellant charge and the associated recoil of the weapon, in that it offsets to a not inconsiderable extent, the need for increasing the amount of propellant charge which would otherwise be necessary. The amount of propellant charge in the propellant charge cartridge of the individual projectiles in the case of the device shown in the drawing, starting with the first projectile i.e. projectile A and ending with the seventh projectile, i.e. projectile G, may for example have the following weights in grams: 7.5, 6.5, 7.5, 8.0, 8.5, 9.0, and 9.5. The delay times of the individual delay action elements would then be, for example, as follows: 1.9 s, 2.1 s, 2.8 s, 3.2 s, 3.8 s, 4.2 s and 4.7 s. On the basis of these two series it is then possible to calculate analogous series for higher or lower quantities of propellant charge or longer or shorter times. The series of propellant charge quantities and delay times of individual delay action elements given here, enable for example, decoy clouds to be formed by means of the device according to the invention shown in the drawing which are at a distance from the target under attack, e.g. large ship, of about 40 m increasing gradually to about 200 m.

The complete discharge process is naturally under command control via an ignition distributor unit according to the input data calculated by the computer connected to it.

The mode of operation of the device according to the invention is as follows:

The primer capsule is detonated by electrically actuating the plug connector insert containing it in the first projectile A and the propellant charge in the assigned propellant charge cartridge is then ignited via this. The gases developed then escape into the ejection chamber by bursting the propellant charge cartridge resulting in the ejection chamber opening due to sheering off of the set screws holding together the cover and the base of the ejection chamber and in the ejection of projectile A from the mouth of the launcher tube. The instant that the base of the ejection chamber connected to projectile A is separated from the base of this ejection chamber fixed to the outer container of the subsequent projectile B, the locking pin in the guide groove of the safety device of projectile A release the mechanical locking of this safety device since the locking pin in the rim of the cup-shaped base of the subsequent projectile remains fixed in position. The safety device is, however, then held in the safe position until it is fully released by the spring of the percussion fuse acting on this safety device after leaving the mouth of the launcher tube, so that the percussion fuse is prepared for firing under the additional influence of the acceleration of projectile A and comes into operation. It then ignites the inflammable composition in the delay action element subsequent to it, and after this has reacted thoroughly the ignition disintegrator charge in the ignition disintegrator unit is finally ignited. The gases which develop as a result cause the aluminium sleeve of this ignition disintegrator unit to open, followed by ignition of the combustible charge around it in the form of combustible sector-shaped flakes. The thin walled inner container and thick walled outer container are also disintegrated directly by this, the disintegration of the latter being facilitated by the grooves parallel to its axis in the outer casing surface which otherwise hold the individual ignition leads. The combustible infrared decoy cloud formed by disintegration of the two containers after ignition of the combustible charge contained inside is largely spherical and has a slow rate of descent. Towards the end of this burning time, a second infrared decoy cloud is then formed in similar fashion directly adjacent to the first infrared decoy cloud by firing projectile B, and this process is continued until the last projectile, i.e. projectile G. is fired from the launcher tube. The infrared decoy cloud formed by the last projectile is then relatively far from the intended target in the propagated chain made up of consecutive infrared decoy clouds in which most of the previously formed decoy clouds are already extinguished, so that the required decoy moving constantly away from the intended target is actually formed. Due to this relatively large distance of the last infrared decoy cloud formed, there is thus virtually no danger anymore for the ship originally at risk from the missile originally aimed at it.

We claim:

1. A projectile assembly for producing a decoy cloud comprising:

(a) a launcher tube having an upper exit end and a lower base end;

(b) a multiplicity of projectiles disposed witin said launcher tube and each comprising a casing providing a chamber, decoy material within said chamber, an ignitable disintegrator component for effecting disintegration of said casing and scattering of said decoy material, an ejection chamber in the base of said casing, propellant means in said ejection chamber for ejecting said projectile from said exit end of said launcher tube, fuse means adapted to ignite said ignitable disintegrator component, and mechanically releasable safety means for preventing operation of said fuse means; and (c) control means in said launcher tube for actuation of said fuse means to effect ignition of said ignitable disintegrator component subsequent to discharge of said projectiles from said launcher tube, said safety means of said projectile assemblies being released upon launching of the projectile from said launcher tube and in response to acceleration of said projectile upon such lauching, said control means also effecting ignition of said propellant means in said ejection chamber to discharge said projectles sequentially from said launcher tube, whereby said projectiles are launched in predetermined time-spaced relationship from said launcher tube as they proceed along a trajectory defined thereby to scatter said decoy material and produce a cloud thereof which extends in the path of said trajectory.

2. The assembly in accordance with claim 1 in which said decoy material is combustible and is ignited by said fuse means and produces a cloud of the burning decoy material to provide an infrared decoy cloud.

3. The assembly in accordance with claim 1 or 2 wherein said fuse means is a percussion fuse and said control means includes a distributor unit to generate an electrical signal and is connected by a lead to said propellant means in said ejection chamber of each of said projectiles.

4. The assembly in accordance with claim 1 or 2 wherein said casing of each of said projectiles includes a thin walled inner container providing said chamber containing the decoy material, a thick walled outer container tightly enclosing said inner container, a cup-shaped cover secured adjacent the lower end of said outer container and providing in cooperation with a cup-shaped base therebelow said ejection chamber therebetween, and means engaging said cup-shaped base and said cup-shaped cover, said inner container providing a gas-tight chamber within said projectile.

5. The assembly in accordance with claim 4 wherein the cup-shaped base is secured to the upper end of the outer container so that said ejection chamber is defined between the top of one projectile and the bottom of the projectile thereabove.

6. The assembly in accordance with claim 4 wherein said ignition disintegrator unit extends coaxially through said inner container.

7. The assembly in accordance with claim 4 wherein both said inner container and outer container are drawn aluminum containers.

8. The assembly in accordance with claim 4 wherein said inner container is closed adjacent its base by a container cover and a crimped joint therebetween to provide a gas-tight seal.

9. The assembly in accordance with claim 4 wherein said outer container has axially extending grooves on its outer surface in which said ignition leads are disposed and extend parallel to its axis.

10. The assembly in accordance with claim 9 wherein said grooves provide predetermined breaking points for said outer container.

11. The assembly in accordance with claim 4 wherein a passage extends eccentrically through the bottom of said cup-shaped base to receive a propellant charge cartridge containing a propellant charge and a recess is provided radially of said passage in the cylindrical side of said base through which a plug connector insert and primer capsule are introduced.

12. The assembly in accordance with claim 4 wherein a passage is provided in the cylindrical side of said base which receives said safety means for said fuse means.

13. The assembly in accordance with claim 11 wherein a guide sleeve is inserted into said first passage and said first passage is closed by said plug connector insert at the outer and of said passage, wherein the chamber formed by said passage and said guide sleeve carries the propellant charge cartridge with said propellant charge therein, said charge being operatively connected to said plug connector insert.

14. The assembly in accordance with claim 4 wherein said cup-shaped cover for said ejection chamber has a locking pin corresponding with the safety means for the fuse means in the cup-shaped base of said projectile.

15. The assembly in accordance with claim 4 wherein said safety means is held in a safety position by the inside surface of the launcher tube.

16. The assembly in accordance with either of claim 2 or 3 including a delay action element positioned between said fuse means and said ignition disintegrator unit.

17. The assembly in accordance with claim 4 wherein said outer container has a groove extending about its outer periphery sealing an O-ring providing sealing action between said projectile and said launcher tube.

18. The assembly in accordance with claim 3 wherein said combustible decoy material consists of a stack of thin sector-shaped flakes coated with a combustible layer and arranged radially about said ignition disintegrator unit, said flakes being in the form of a sector with an included angle of about 120°.

19. The assembly in accordance with claim 3 wherein said sector-shaped flakes form a circle and are joined together by a thin connecting strip.

* * * * *